US008526850B2

(12) United States Patent
Sasaki et al.

(10) Patent No.: US 8,526,850 B2
(45) Date of Patent: Sep. 3, 2013

(54) IMAGE FORMING APPARATUS AND PROCESS CARTRIDGE

(75) Inventors: Hiraku Sasaki, Susono (JP); Yasushi Shimizu, Yokohama (JP)

(73) Assignee: Canon Kabushik Kaisha, Tokyo (JP)

( * ) Notice: Subject to any disclaimer, the term of this patent is extended or adjusted under 35 U.S.C. 154(b) by 308 days.

(21) Appl. No.: 12/968,497

(22) Filed: Dec. 15, 2010

(65) Prior Publication Data

US 2011/0150526 A1 Jun. 23, 2011

(30) Foreign Application Priority Data

Dec. 18, 2009 (WO) ..... PCT/JP2009/071106

(51) Int. Cl.
*G03G 21/16* (2006.01)

(52) U.S. Cl.
USPC ..... 399/111; 399/107; 399/110; 399/119; 399/125

(58) Field of Classification Search
USPC ..... 399/110, 111, 119, 107, 125
See application file for complete search history.

(56) References Cited

U.S. PATENT DOCUMENTS

| | | | | |
|---|---|---|---|---|
| 5,019,867 | A | 5/1991 | Yamakawa | |
| 5,697,022 | A | 12/1997 | Matsuda | |
| 7,161,281 | B2 | 1/2007 | Takeuchi | |
| 2005/0047822 | A1 * | 3/2005 | Hashimoto et al. | 399/111 |
| 2006/0216061 | A1 * | 9/2006 | Yamaguchi | 399/111 |
| 2010/0129101 | A1 * | 5/2010 | Muto | 399/53 |

FOREIGN PATENT DOCUMENTS

| | | | |
|---|---|---|---|
| JP | 59-223468 | A | 12/1984 |
| JP | 2-71278 | A | 3/1990 |
| JP | 6-313996 | A | 11/1994 |
| JP | 2001-66970 | A | 3/2001 |
| JP | 2002-189401 | A | 7/2002 |
| JP | 2005-164756 | A | 6/2005 |
| JP | 2010091981 | A * | 4/2010 |

* cited by examiner

*Primary Examiner* — David Gray
*Assistant Examiner* — Francis Gray
(74) *Attorney, Agent, or Firm* — Canon USA Inc. IP Division

(57) ABSTRACT

To provide an image forming apparatus in which variations in the contact pressure produced between a photosensitive drum and a developing roller is suppressed, whereby image quality can be improved. A development unit and a drum unit are rotatably connected to each other with a link member interposed therebetween. Gears for transmitting a driving force are supported at two rotation support points of the link member, whereby the driving force is transmitted to the development unit.

15 Claims, 13 Drawing Sheets

IMAGE FORMING APPARATUS AND PROCESS CARTRIDGE

TECHNICAL FIELD

The present invention relates to an image forming apparatus and a process cartridge.

BACKGROUND ART

Hitherto, in development systems employing nonmagnetic monocomponent developer, a contact development method in which an elastic roller is used is widely employed, as described in Japanese Patent Laid-Open No. 2005-164756. A process cartridge mountable into and demountable from an image forming apparatus includes a drum unit and a development unit. The drum unit includes a photosensitive drum on which an electrostatic latent image is to be formed, a charging roller, and a cleaning device. The development unit includes a developing roller and a toner container.

In the contact development method, the developing roller having a layer of developer formed on the surface thereof is brought into contact with the photosensitive drum having an electrostatic latent image formed thereon. Subsequently, an electric field is produced between the photosensitive drum and the developing roller, whereby the electrostatic latent image on the photosensitive drum is visualized with the developer.

To bring the developing roller into contact with the photosensitive drum, the drum unit and the development unit are rotatably connected to each other at a connecting portion and are pressed against each other with a spring. Furthermore, to transmit a driving force to the developing roller, a driving gear having the center of rotation thereof at the connecting portion is supported and transmits the driving force from a drive motor to the development unit.

Meanwhile, as disclosed in Japanese Patent Laid-Open No. 2001-66970, another configuration is proposed in which a development unit is connected to a drum unit in such a manner as to be movable in the substantially horizontal direction in a state where a process cartridge is mounted in an image forming apparatus.

In the contact development method, however, the contact pressure produced between the photosensitive drum and the developing roller needs to be controlled. A contact pressure over a specific range of values causes problems such as deterioration of developer due to an overload on the developer provided at the point of contact and fusion of developer onto the developing roller. In contrast, a contact pressure below the specific range of values causes problems such as image dropouts and a reduction in the image density due to a reduced development efficiency. To avoid such problems, in the process cartridge described in Japanese Patent Laid-Open No. 2005-164756, the contact pressure is determined on the basis of the urging force of the spring and the driving force of the driving gear. The driving force changes with changes in internal loads of the development unit, such as a change in a developer-stirring load and a change in the frictional force at the point of slidable contact occurring in the development unit. Along with such changes, the contact pressure may also change. On the other hand, in the process cartridge disclosed in Japanese Patent Laid-Open No. 2001-66970, the contact pressure produced between the photosensitive drum and the developing roller is maintained to be constant, without being affected by the weight of the development unit. However, since the development unit slides with respect to the drum unit, the positional accuracy of a driving-force input portion of the development unit is not good. Therefore, an error in the meshing between the driving-force input portion of the development unit and the driving gear provided on the apparatus body may lead to nonuniformity in the transmission of the driving force and the image may be affected.

Accordingly, it is an object of the present invention to provide an image forming apparatus and a process cartridge in which the contact pressure produced between a photosensitive drum and a developing roller is controllable with high accuracy without causing a meshing error of a driving gear and image quality can be thus improved.

SUMMARY OF INVENTION

A representative invention for achieving the above object provides the following.

A process cartridge mountable into and demountable from an image-forming-apparatus body, the process cartridge including an image bearing member, a first frame member by which the image bearing member is rotatably supported, a developer bearing member that is pressed against the image bearing member and with which an electrostatic latent image formed on the image bearing member is developed, a second frame member by which the developer bearing member is rotatably supported, a link member rotatably connected to the first frame member and the second frame member at a first connecting portion and a second connecting portion, respectively, and connecting the first frame member and the second frame member to each other in such a manner as to be movable with a two-joint link mechanism, an urging member urging the first frame member and the second frame member such that the image bearing member and the developer bearing member are pressed against each other, a first gear rotatably provided at the first connecting portion and receiving a driving force from a drive source provided on the apparatus body, and a second gear rotatably provided at the second connecting portion and transmitting the driving force from the first gear to the developer bearing member.

Another invention for achieving the above object provides the following. An image forming apparatus forming an image on a recording medium, the apparatus including an image bearing member, processing means acting on the image bearing member, a first frame member by which one of the image bearing member and the processing means is rotatably supported, a second frame member by which the other of the image bearing member and the processing means is rotatably supported, a link member rotatably connected to the first frame member and the second frame member at a first connecting portion and a second connecting portion, respectively, and connecting the first frame member and the second frame member to each other in such a manner as to be movable with a two-joint link mechanism, an urging member urging the first frame member and the second frame member such that the image bearing member and the processing means are pressed against each other, a first gear rotatably provided at the first connecting portion and receiving a driving force from a drive source, and a second gear rotatably provided at the second connecting portion and transmitting the driving force from the first gear to the processing means.

Further features of the present invention will become apparent from the following description of exemplary embodiments with reference to the attached drawings.

DESCRIPTION OF EMBODIMENTS

First Embodiment

The best modes for embodying the present invention will now be exemplified in detail with reference to the drawings. The dimensions, materials, and shapes of elements, relative positions between the elements, and the like described in the following embodiments are subject to appropriate change depending on the configuration of an apparatus to which the present invention is to be applied and various other conditions, and do not limit the scope of the present invention to the following embodiments.

Image Forming Apparatus

Figure 2:
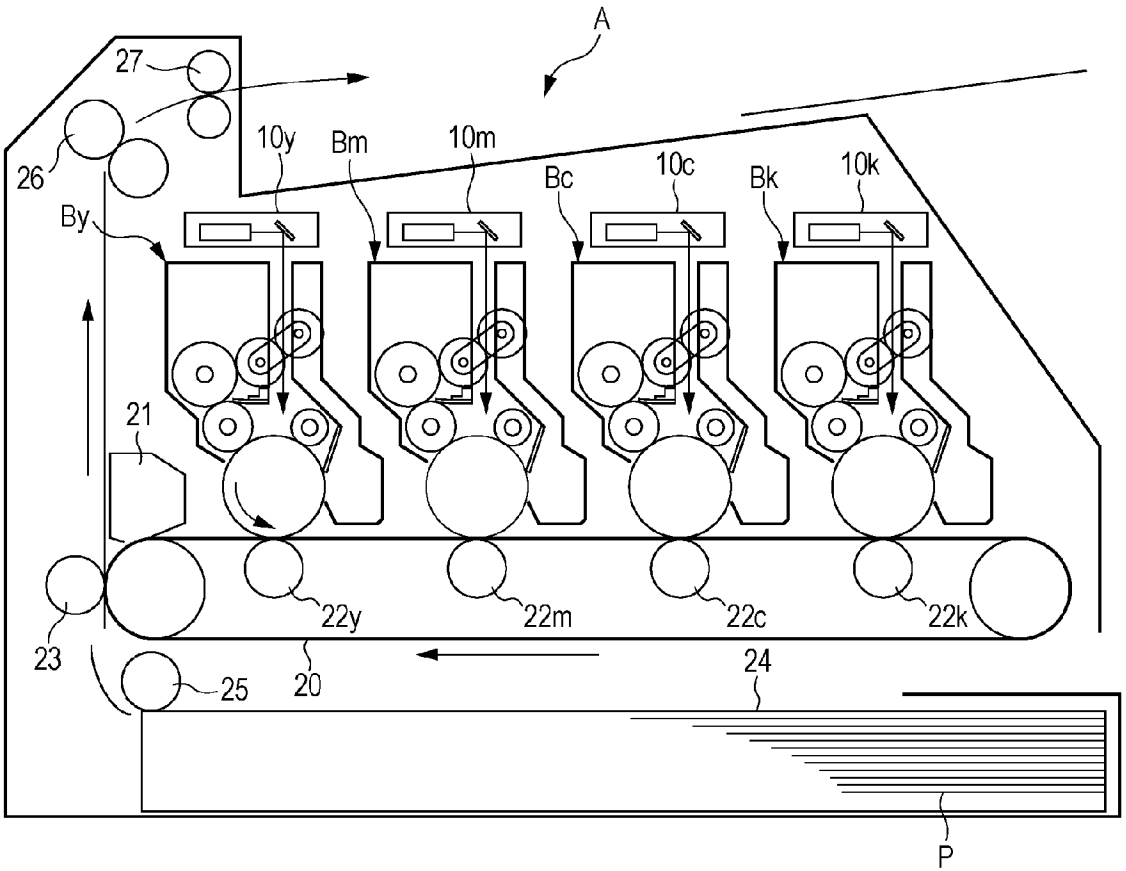
FIG. 2 is a schematic cross-sectional view showing an exemplary image forming apparatus to which the configuration according to the present invention is applied.

FIG. 2 is a cross-sectional view showing the overall configuration of an image forming apparatus according to an embodiment.

The image forming apparatus described herein is a full-color laser printer performing an electrophotographic process and includes an image-forming-apparatus body A and process cartridges B mountable into and demountable from the image-forming-apparatus body A. The process cartridges B are each an integral body including a drum unit C, which is a first frame member, and a development unit D, which is a second frame member.

The process cartridges B (By, Bm, Bc, and Bk) are provided for colors of yellow, magenta, cyan, and black, respectively. The process cartridges B are arranged in parallel. Toner images formed on photosensitive drums (image bearing members) 1 in the process cartridges for the respective colors are transferred to an intermediate transfer belt 20 included in a transfer device, whereby a full-color image is formed. Subsequently, through a transfer step and a fixing step performed on a piece of recording material, an image is finished.

Toners of the respective colors used in this image forming apparatus are nonmagnetic monocomponent toners having an average particle size of 6.0 μm. Details of each process cartridge B will be described separately below.

The toner images formed on the photosensitive drums 1 by the process cartridges for the respective colors are transferred to the intermediate transfer belt 20 by primary transfer rollers 22*y*, 22*m*, 22*c*, and 22*k* provided at positions facing the respective photosensitive drums 1 for the above colors with the intermediate transfer belt 20 interposed therebetween. The toner images transferred to the intermediate transfer belt 20 are transferred as a set to a piece of recording material by a secondary transfer roller 23 provided on the downstream side in the direction in which the intermediate transfer belt 20 moves. Untransferred toner remaining on the intermediate transfer belt 20 is collected by an intermediate-transfer-belt cleaner 21.

Pieces of recording material P are stacked in a cassette 24 provided at the bottom of the image-forming-apparatus body A. In response to a request for an image forming operation, a piece of recording material P is conveyed by a feed roller 25. The toner images formed on the intermediate transfer belt 20 are transferred to the piece of recording material P at a position of transfer with the secondary transfer roller 23.

Subsequently, the toner images on the piece of recording material are fixed to the piece of recording material with heat by a fixing unit 26, and the recording material is discharged through a discharge unit 27 to the outside of the image-forming-apparatus body A.

In the image forming apparatus according to the present embodiment, an upper unit that houses the process cartridges for the four respective colors and so forth and a lower unit that houses the transfer device, the recording material, and so forth are separable. Thus, when a jam of recording material or the like occurs or when any of the process cartridges is to be replaced, the upper and lower units are separated, whereby clearing of the jam and replacement of the cartridge can be performed easily.

Process Cartridge

The configuration of the process cartridges B will now be described.

Figure 1:
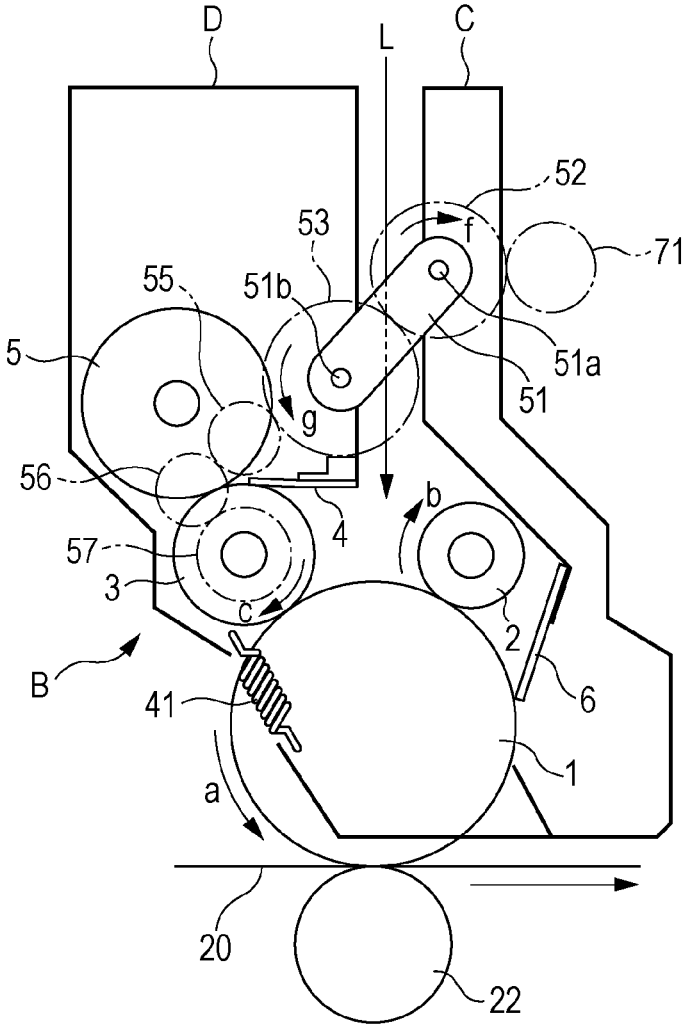
FIG. 1 is a schematic cross-sectional view showing a process cartridge and relevant parts therearound according to a first embodiment of the present invention.

FIG. 1 is a cross-sectional view schematically showing the configuration of one of the four process cartridges By, Bm, Bc, and Bk arranged in parallel in one direction. The four process cartridges By, Bm, Bc, and Bk essentially have the same configuration, except that toners used therefor are different.

The photosensitive drum 1, playing a leading role in an image forming process (image forming operation), is an organic photosensitive drum in which an aluminum cylinder is coated on the peripheral surface thereof with functional films including an underlayer, a carrier generating layer, and a carrier transporting layer in that order. In the image forming process, the photosensitive drum 1 is driven at a specific speed in the direction of an arrow a shown in FIG. 1.

A charging roller 2 as a charging device has a conductive-rubber roller portion thereof pressed against the photosensitive drum 1, thereby being driven to rotate in the direction of an arrow b shown in FIG. 1. The charging roller 2 has a metal core bar through which a direct-current voltage of −1100V is applied to the photosensitive drum 1 in a charging step. With the charge thus induced, the photosensitive drum 1 has a surface potential that is a uniform dark-area potential (Vd) of −550V.

The uniformly charged surface of the photosensitive drum 1 is exposed with a spot pattern of a laser beam emitted from a scanner unit 10 in accordance with image data, as represented by an arrow L in FIG. 1. In the regions of the photosensitive drum 1 that have been exposed, the surface charge is lost because of carriers generated from the carrier generating layer, whereby the potential is reduced. Consequently, an electrostatic latent image including the exposed regions having a light-area potential V1 of −100V and the unexposed regions having a dark-area potential Vd of −550V is formed on the photosensitive drum 1.

The electrostatic latent image formed on the photosensitive drum 1 is developed with a toner coat layer formed on a rotatable developing roller (processing means) 3 as a developer bearing member with a specific amounts of coat and charge. The configuration of the development unit D will be described separately below.

The developing roller 3 rotates in the forward direction (the direction of an arrow c shown in FIG. 1) relative to the direction of rotation of the photosensitive drum 1 while being in contact with the photosensitive drum 1. A DC bias of −350 V is applied to the developing roller 3 in the image forming step. At a development portion where toner negatively charged with triboelectrification on the developing roller 3 comes into contact with the photosensitive drum 1, the toner is transferred only to the regions having the light-area potential because of the potential difference therebetween, whereby the electrostatic latent image formed on the photosensitive drum 1 is visualized.

The intermediate transfer belt 20 that is in contact with the photosensitive drums 1 of the process cartridges B is pressed against the photosensitive drums 1 by the primary transfer rollers 22*y*, 22*m*, 22*c*, and 22*k* facing the respective photosensitive drums 1. A direct-current voltage is applied to the primary transfer rollers 22*y*, 22*m*, 22*c*, and 22*k*, whereby electric fields are produced between the primary transfer rollers 22*y*, 22*m*, 22*c*, and 22*k* and the photosensitive drums 1.

Thus, at transfer areas where the pressing is performed, the toner images visualized on the photosensitive drums 1 are transferred from the photosensitive drums 1 to the intermediate transfer belt 20 under the forces of the electric fields.

Meanwhile, untransferred toner remaining on each photosensitive drum 1 without being transferred to the intermediate transfer belt 20 is scraped off the surface of the photosensitive drum 1 by a urethane-rubber cleaning blade 6 provided in the drum unit C, and is collected in the drum unit C (a cleaning case).

Figure 3:
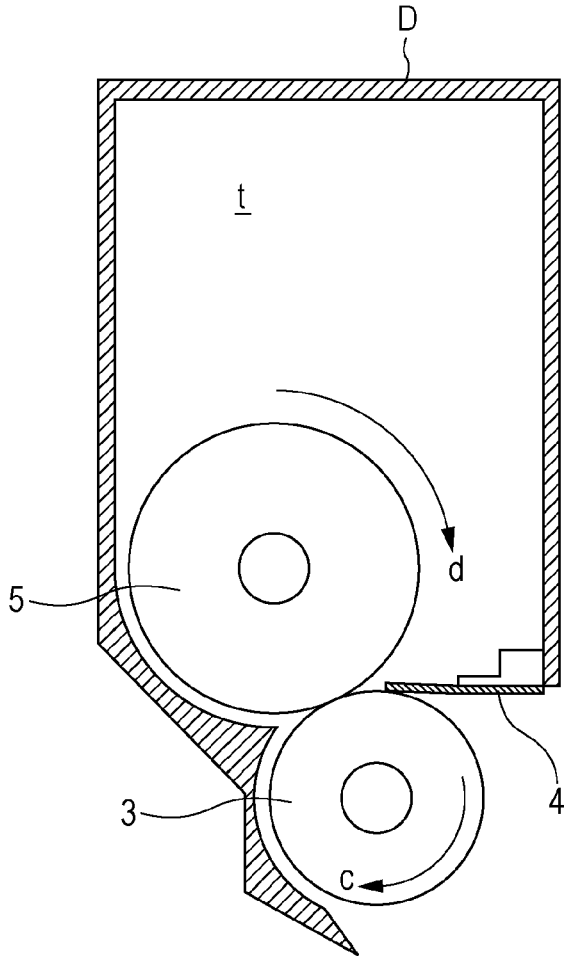
FIG. 3 is a schematic cross-sectional view of a development unit according to the invention.

FIG. 3 is a schematic cross-sectional view of the development unit D.

The development unit D includes the developing roller 3 as a developer bearing member, a supply roller 5 as a developer supplying member, a regulating member 4, toner t, a development case housing the foregoing elements, and so forth. The developing roller 3 is intended for developing the electrostatic latent image on the photosensitive drum 1 by being in contact with the photosensitive drum 1. The supply roller 5 is intended for supplying the toner t by being in contact with the developing roller 3.

The regulating member 4 is a sheet-like elastic member supported by a supporting member in such a manner as to be in contact with the surface of the developing roller 3. The regulating member 4 corresponds to a developer-layer-thickness-regulating member that regulates the thickness of a layer of toner borne on the developing roller 3.

The developing roller 3 is an elastic roller having an outside diameter ϕ of 12 mm in which a 3-mm-thick conductive elastic layer is formed on a metal core bar having an outside diameter ϕ of 6 mm. The volume resistivity of the elastic layer is adjusted to be $10^6$ Ωcm. A coat layer or the like having a function of giving charge to toner may also be provided on the surface of the elastic roller. To obtain a specific amount of toner coat, the surface roughness Rz of the developing roller 3 is set to be 6 μm.

The supply roller 5 is an elastic sponge roller having an outside diameter ϕ of 16 mm in which a 5.5-mm-thick elastic layer made of insulating urethane sponge rubber and having a volume resistivity of $10^{14}$ Ωcm is formed on a metal core bar having an outside diameter ϕ of 5 mm.

The developing roller 3 rotates in the forward direction (the direction of the arrow c in FIG. 3) relative to the direction of rotation of the photosensitive drum 1 while being in contact with the photosensitive drum 1. The supply roller 5 rotates in the reverse direction (the direction of an arrow d in FIG. 3) relative to the direction of rotation of the developing roller 3 while being in contact with the developing roller 3.

The supply roller 5 has a function of supplying the toner t, which is nonmagnetic monocomponent toner, in the development case to the developing roller 3 by making the toner t adhere thereto and conveying the toner t to the point of contact with the developing roller 3. The supply roller 5 also has a function of collecting the toner that has not been developed at the development portion and is remaining on the developing roller 3 into the development case by scraping the toner off the developing roller 3.

When the nonmagnetic monocomponent toner supplied from the supply roller 5 to the developing roller 3 passes the contact surface between the developing roller 3 and the regulating member 4, the toner is charged by triboelectrification, and the thickness of the coat layer is regulated. Thus, a toner coat layer having a specific amount of charge and a specific thickness is formed.

Link Mechanism

A link mechanism characterizing the present embodiment will now be described.

FIG. 1 is a schematic cross-sectional view of the process cartridge B according to the present embodiment. The characteristic configuration and behavior of the process cartridge B will now be described.

The drum unit C and the development unit D are connected to each other with a link member 51 interposed therebetween. The drum unit C and the development unit D are rotatably supported by the link member 51 at a first connecting portion 51*a* and a second connecting portion 51*b*, respectively. The link member 51 supports at both ends thereof a pair of a drive input gear 52 and a development driving gear 53 having the axes of rotation thereof at the first connecting portion 51*a* and the second connecting portion 51*b*, respectively. The link member 51 maintains the distance between the axes of the drive input gear 52, which is a first gear, and the development driving gear 53, which is a second gear, to be constant. Therefore, there is no possibility of unstable meshing between the drive input gear 52 and the development driving gear 53. A driving force is transmitted to the drive input gear 52 by a drive motor 71, which is a drive source, supported by the image-forming-apparatus body A, whereby the drive input gear 52 is rotated in the direction of an arrow f. Then, the development driving gear 53 meshing with the drive input gear 52 is rotated in the direction of an arrow g, whereby the driving force is transmitted into the development unit D. The driving force thus transmitted is further transmitted by idler gears 55 and 56 to a developing-roller-driving gear 57 supported by the axis provided for the developing roller 3, whereby the developing roller 3 is driven in a specific direction. The link member 51 is provided on one side of the drum unit C and the development unit D in the longitudinal direction of the photosensitive drum 1. Another link member (not shown) having the same configuration is provided on the other side of the drum unit C and the development unit D but with no gears.

On the other hand, a tension spring 41, which is an urging member, is stretched between the drum unit C and the development unit D so that a load acts in a direction in which the photosensitive drum 1 and the developing roller 3 are brought toward each other. The load and the stretching direction are determined so that the orientation of the development unit D is stabilized.

The elastic layer of the developing roller may be made of silicon rubber or EPDM rubber. In a case where the developing roller has an Asker C hardness of 50 degrees with an elastic layer made of silicon rubber and the resistance thereof adjusted with a conductive agent such as carbon black, the accuracy in runout on the outside diameter thereof is ±50 μm or smaller. In a case where the developing roller has an Asker C hardness of 70 degrees with an elastic layer made of EPDM rubber, the accuracy in runout on the outside diameter thereof is ±20 μm or smaller.

Factors that affect the contact pressure produced between the photosensitive drum and the developing roller in the case where silicon rubber is employed and in the case where EPDM rubber is employed will be described separately below.

The mechanism of suppressing changes in the pressing force applied by the link mechanism with which the drum unit C and the development unit D are pressed against each other will now be described.

Usually, with the driving force from the drive motor, the development unit rotates about the second connecting portion 51*b* in the same direction (the direction of the arrow g) as the development driving gear 53 does, as shown in FIG. 1. This is because of frictions between the rollers occurring in the development unit D and loads occurring with stirring of the toner and the like, and is characteristic of a configuration in which the development unit D is supported in such a manner as to be rotatable relative to the drum unit C. In such a case, when the driving force changes, the amount of rotation of the development unit D also changes, affecting the contact pressure produced between the photosensitive drum 1 and the developing roller 3 at the point of contact between the drum unit C and the development unit D.

The change in the driving force occurs more frequently with the duration of use. This is because of changes in internal loads such as changes in the frictional forces occurring between the rollers and a change in the toner-stirring load occurring with the consumption of toner. Since the drive motor in the image-forming-apparatus body has such specifications as to maintain the speeds of rotation of the developing roller 3 and the supply roller 5 at constant levels, the driving force increases with increase in the internal loads and decreases with decrease in the internal loads. Therefore, in a configuration not including the link mechanism, changes in the driving force directly lead to changes in the contact pressure produced between the photosensitive drum and the developing roller.

In the present embodiment, however, in which the link member 51 is interposed between the drum unit C and the development unit D, not only a rotary motion about the second connecting portion 51*b* but also a rotary motion about the first connecting portion 51*a* act on the development unit D. That is, the drum unit C and the development unit D form a movable configuration with a so-called two-joint link mechanism. Thus, for example, when the driving force has increased, the development unit D tends to rotate more strongly in the direction of the arrow g and also tends to rotate in the direction of the arrow f. Here, the forces in the respective directions act to offset each other in parts thereof. Therefore, changes in the distance between the axes of the photosensitive drum 1 and the developing roller 3 are suppressed. Consequently, changes in the contact pressure can be suppressed.

Figure 9A:
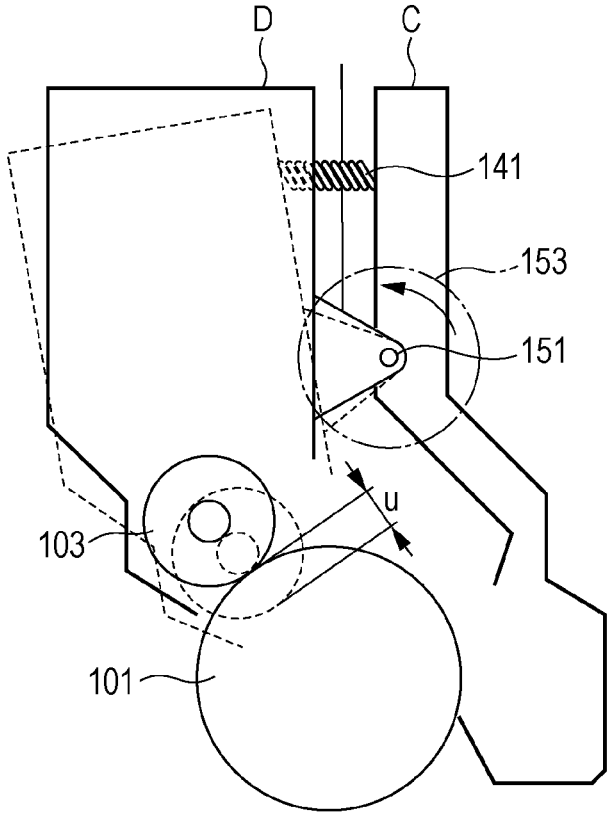
FIGS. 9A and 9B are schematic cross-sectional views each showing the positional relationship between a drum unit and the development unit when the driving force has increased.
Figure 9B:
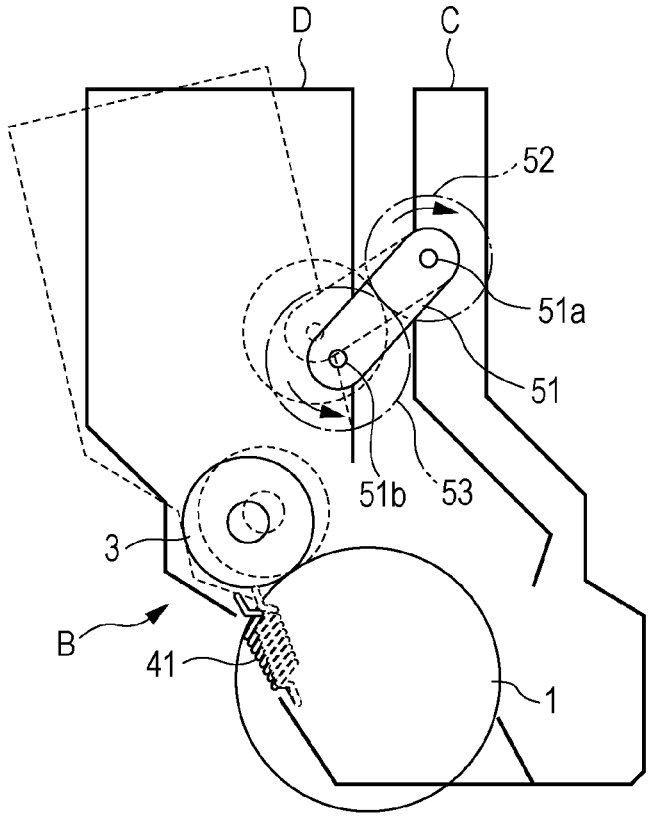

The positional relationship between the drum unit C and the development unit D when the driving force has increased will now be described with reference to FIGS. 9A and 9B. The position of the development unit D when the driving force has increased is shown by dashed lines. For explicit representation of the positional relationship, the amount of travel is exaggerated. FIG. 9A shows a configuration according to a comparative example in which the drum unit C and the development unit D are connected to each other only at a connecting portion 151. Since the development unit D rotates about the connecting portion 151, an increase in the contact pressure corresponding to an encroaching amount u occurs at the point of contact between a photosensitive drum 101 and a developing roller 103. In contrast, in the first embodiment shown in FIG. 9B, the development unit D rotates about the second connecting portion 51*b* while the link member 51 rotates about the first connecting portion 51*a* in a direction opposite to the direction in which the development unit rotates. Thus, changes in the distance between the axes of the photosensitive drum 1 and the developing roller 3 are suppressed. Consequently, changes in the contact pressure can be suppressed.

Figure 10:
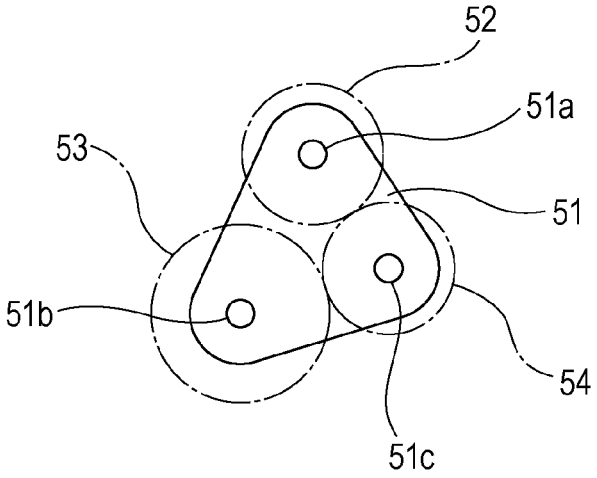
FIG. 10 is a schematic diagram showing a case where an idler gear is rotatably supported by a link member.

The above description concerns a case where the driving force is directly transmitted from the drive input gear 52 to the development driving gear 53. In another case shown in FIG. 10 where an idler gear 54 is interposed between the drive input gear 52 and the development driving gear 53, the effect brought by the link mechanism described above is also produced. The idler gear 54 is rotatably supported by the link member 51 at a gear-rotation-supporting portion 51*c*. As in the case described above, since a force produced by the meshing between the drive input gear 52 and the idler gear 54 acts in such a manner as to offset part of the change in the contact pressure produced between the photosensitive drum and the developing roller, changes in the contact pressure can be suppressed. With the idler gear 54, the degree of freedom in configuring the process cartridge can be increased.

The behaviors of forces that act when the driving force is transmitted to the link mechanism will now be described in detail with reference to FIGS. 4A to 4C.

Figure 4A:
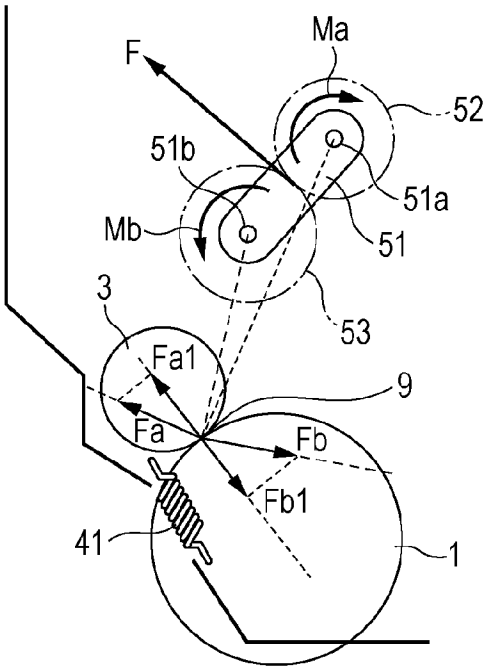
FIGS. 4A to 4C are schematic cross-sectional views each showing the behaviors of forces that act when a driving force is transmitted to a link mechanism.

A load F shown in FIG. 4A is the load acting on the development driving gear 53 with the meshing between the drive input gear 52 and the development driving gear 53. A moment Ma is the moment of a force acting on the link member 51 about the first connecting portion 51*a* under the load F. A moment Mb is the moment of a force acting on the development driving gear 53 about the second connecting portion 51*b* under the load F. Here, a load Fa occurring with the moment Ma and a load Fb occurring with the moment Mb act at the point of contact 9 between the photosensitive drum 1 and the developing roller 3. The load acting as the contact pressure includes a load Fa1 and a load Fb1, which are components of the load Fa and the load Fb, respectively, perpendicular to the point of contact 9.

Figure 4B:
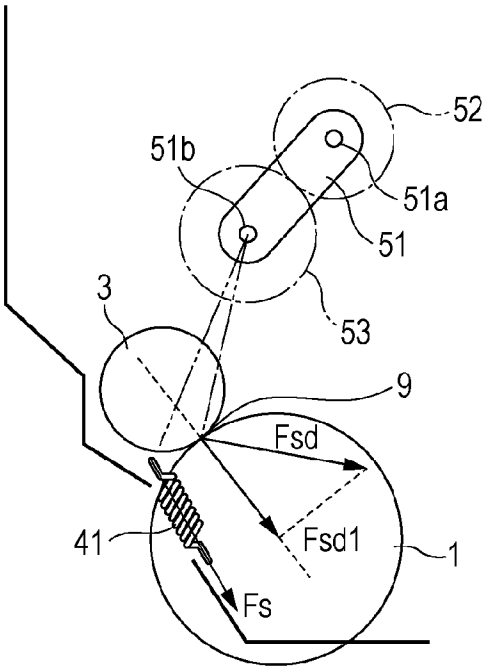

A load Fs shown in FIG. 4B is the load produced by the tension spring 41 and acting on the development unit D. Here, a load Fsd occurring with a moment produced by the load Fs and acting about the second connecting portion 51*b* acts at the point of contact between the photosensitive drum 1 and the developing roller 3. The load acting as the contact pressure includes a load Fsd1, which is a component of the load Fsd perpendicular to the point of contact 9.

Figure 4C:
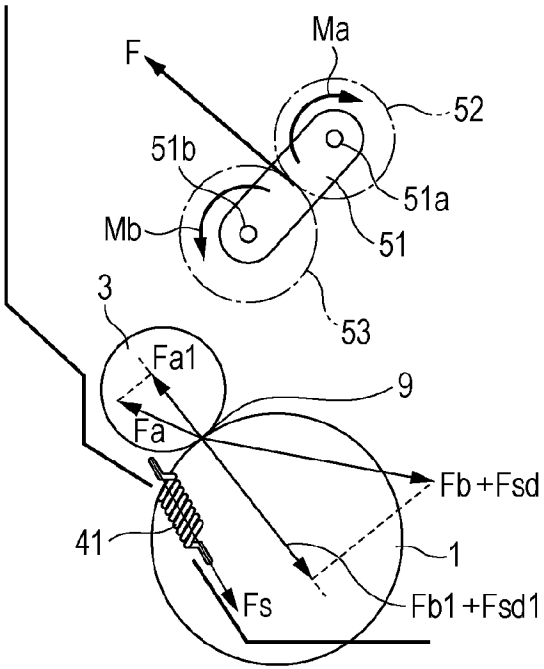

FIG. 4C shows the loads acting at the point of contact between the photosensitive drum 1 and the developing roller 3, the loads being shown as a combination of components perpendicular to the contact surface. As is obvious from the drawing, the contact pressure produced between the photosensitive drum 1 and the developing roller 3 is determined as the sum total of the loads Fa1, Fb1, and Fsd1. For example, when the driving force transmitted from the image-forming-apparatus body to the drive input gear 52 increases, the load F increases. Accordingly, with the increase in the load F, the moments Ma and Mb increase. The increments in the load Fa1 and the load Fb1 at the point of contact due to the increase in the moments offset each other in parts thereof. Consequently, increase in the contact pressure produced between the photosensitive drum 1 and the developing roller 3 is suppressed.

Here, if the diameters and arrangement of the gears are set such that the load Fa1 and the load Fb1 are equal to each other in magnitude but opposite to each other in direction, changes in the contact pressure produced between the photosensitive drum 1 and the developing roller 3 occurring in response to changes in the driving force can be minimized.

Figure 5:
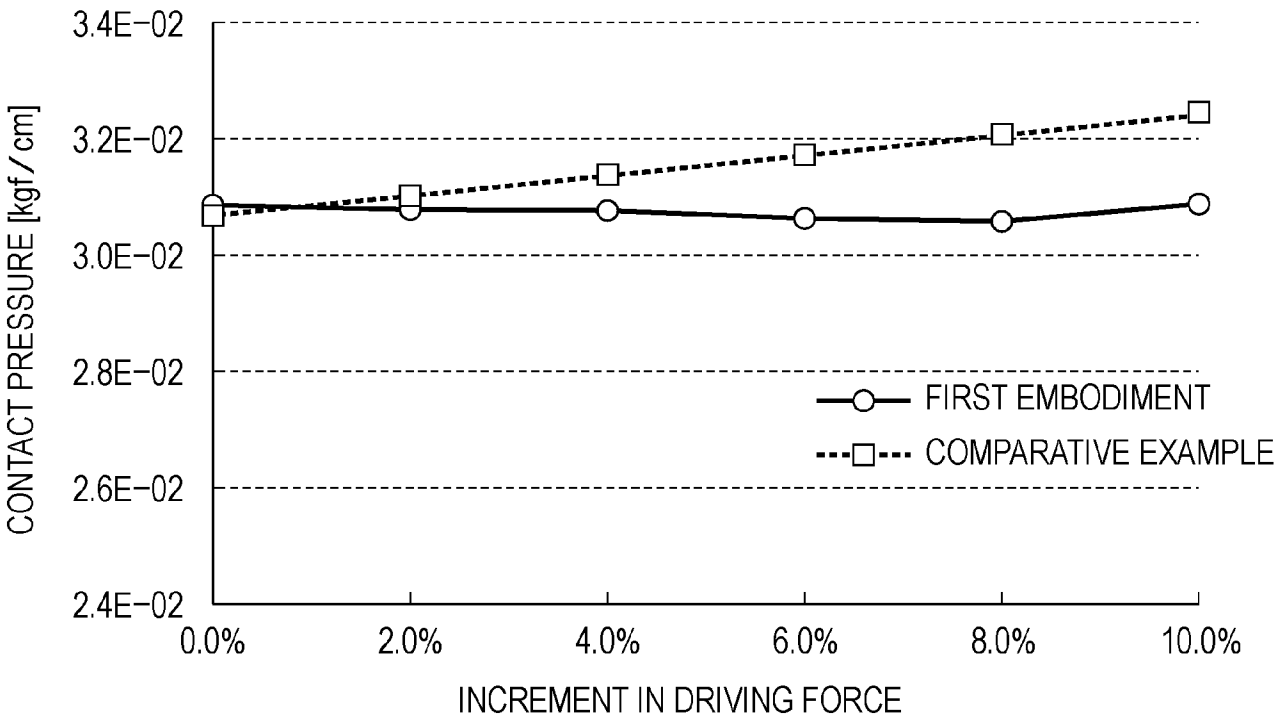
FIG. 5 is a graph for comparing contact pressure between the first embodiment and a comparative example.

To demonstrate the effect produced in the case where the elastic layer is made of silicon rubber, a simulation was conducted in which changes in the contact pressure produced between the photosensitive drum and the developing roller in response to changes in the driving force were compared with those in the comparative example (shown in FIG. 9A). The results are shown in FIG. 5. The horizontal axis represents the increment in the driving force. An increment of 0% represents a state where there is no change in the driving force. The vertical axis represents the contact pressure as linear load. As is obvious from the graph, even if the driving force increases, increase in the contact pressure produced between the photosensitive drum 1 and the developing roller 3 is suppressed.

Conditions for Pressing with Urging Spring

Figure 6:
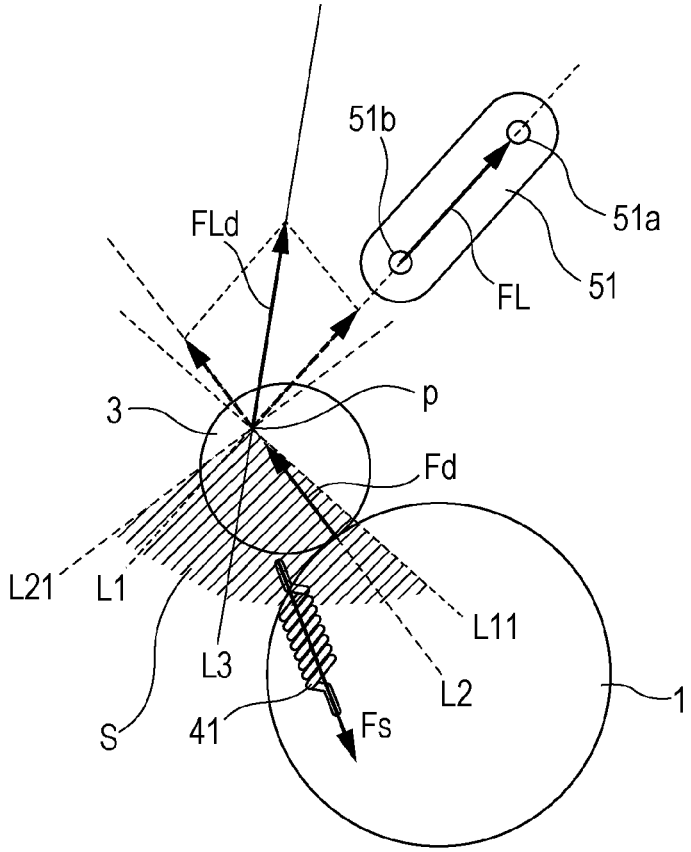
FIG. 6 is a schematic diagram for describing a mechanism of maintaining the orientation of the development unit.

In contrast to the comparative example, the link mechanism provides an increased degree of freedom in position. Therefore, to stabilize the orientation of the development unit D, the direction of pressing with the urging spring needs to be set appropriately. If this setting is inappropriate, problems such as interference between the drum unit and the development unit may occur. Referring to FIG. 6, the setting for the pressing with the urging spring will now be described. The following description is based on the premise that loads occur in a cross section perpendicular to the axis of rotation of the photosensitive drum 1, which do not affect the essence of the setting for the pressing with the urging spring.

In the state where the photosensitive drum 1 and the developing roller 3 are pressed against each other, the load that affects the orientation of the development unit includes three loads: a load FL occurring between the development unit and the link member 51, a contact load Fd occurring between the photosensitive drum 1 and the developing roller 3, and the load Fs produced by the urging spring 41. The load FL occurs on a line L1 connecting the first connecting portion 51*a* and the second connecting portion 51*b*. The load Fd occurs on a line L2 connecting the center of rotation of the photosensitive drum 1 and the center of rotation of the developing roller 3. Here, a resultant FLd of the load FL and the load Fd occurs on a line L3 passing the intersection p of the lines L1 and L2. The orientation of the development unit is most stabilized if the load Fs occurs on the line L3 with a vector inverse to the resultant FLd. Actually, however, because of the sliding frictions at the first connecting portion 51*a* and the second connecting portion 51*b* and the friction between the photosensitive drum 1 and the developing roller 3, the stability of the development unit can be maintained even if the vector of the load Fs is not exactly inverse to the resultant FLd. Conditions for such a situation will now be described. Since a tension load needs to be constantly produced on the link member 51, a component of the load Fs that is parallel to the load FL needs to be in a direction opposite to the direction of the load FL. Furthermore, since the photosensitive drum 1 and the developing roller 3 need to be constantly pressed against each other, a component of the load Fs that is parallel to the load Fd needs to be in a direction opposite to the direction of the load Fd. The condition of the load Fs that satisfies the above situation is as follows. When an area S is defined by a line L11 orthogonal to the line L1 and a line 21 orthogonal to the line L2 in such a manner as to include the line L3 but not to include the resultant FLd, and the starting point of the vector representing the load Fs is defined at the intersection p, the terminal point of the vector representing the load Fs resides within the area S. Here, the points at which the urging spring 41 is supported may reside on the outside of the area S, as long as the above condition is satisfied.

In addition, if the urging spring is a tension spring, a greater effect is obtained. This is because of the following reason. Since the direction of a load produced by a tension spring is determined only by two points supporting the tension spring, the above condition of the vector can be maintained stably.

Influence of Peak Pressure in Contact Pressure Distribution

As described as the problems in the comparative example, the problem regarding the pressing of the developing roller against the photosensitive drum includes the problem in controlling the contact pressure. When the contact pressure increases, the degree of closeness between the photosensitive drum and the developing roller increases. Therefore, the force applied to developer provided at the point of contact increases. Consequently, the toner surface melts, and external additive on the toner surface is embedded in the toner surface. This tends to reduce charging performance. Moreover, a phenomenon that, for example, the melted toner is fused onto the surface of the developing roller tends to occur more often.

Fusion of toner is a problem regarding the melting point of toner and becomes more pronounced when the melting point of toner exceeds a threshold. Accordingly, regarding the contact pressure and the fusion of the toner surface, the above phenomenon becomes more pronounced when the pressure reaches a specific level. Therefore, considering the problems described above, it is important to prevent the occurrence of any local region subjected to a pressure larger than a specific value, rather than to control the gross load produced between the photosensitive drum and the developing roller.

In general, it is difficult to make the contact pressure produced between the photosensitive drum and the developing roller uniform in the longitudinal direction. This is because the developing roller bends. Since the developing roller is pressed while being supported at both ends of the metal core bar thereof, the developing roller bends more significantly when the pressing force applied thereto is larger, the metal core bar thereof is thinner, and the hardness of rubber thereof is higher.

The pressure distribution in the longitudinal direction is such that, if the outside diameter of the developing roller is uniform, the pressure increases toward the ends of the developing roller. Therefore, if the outside diameter of the central portion of the developing roller is made smaller than the outside diameters at the ends of the developing roller, the pressure may be made uniform in the longitudinal direction.

In the case, however, where the pressing force applied to the photosensitive drum changes as described as one of the problems to be solved by the present invention, when the pressing force is reduced, for example, the pressure applied to the central portion of the developing roller is reduced, preventing the photosensitive drum and the developing roller from coming into contact with each other. Consequently, a problem of incapability in development occurs.

A printing endurance test was conducted on a configuration similar to that of the comparative example, on the condition that the contact pressure produced between the photosensitive drum and the developing roller did not change. As a result, when the contact pressure produced between the photosensitive drum and the developing roller was over 150 gf/cm in linear load, fusion of developer onto the developing roller occurred and resulted in image failure at the end of the printing endurance test, specifically, after about 5000 sheets of images were output, regardless of the hardness of the developing roller. The contact pressure distribution was measured with a tactile sensor (Nitta Corporation) employing a sheet-type pressure distribution sensor.

It was also found that, when the contact pressure was set to be low, specifically, when the contact pressure was about 5 gf/cm, no print dropouts occurred. Hence, in a configuration similar to that of the image forming apparatus according to the first embodiment and the like of the present invention, it can be said that the contact pressure produced between the photosensitive drum and the developing roller needs to be within the range of 5 to 150 gf/cm in every region in the longitudinal direction.

The peak contact pressure in the longitudinal direction tends to become higher as the rubber hardness increases. The distribution of the contact pressure produced between the photosensitive drum and the developing roller was measured on a developing roller having a hardness of 50 degrees and a runout accuracy of ±5 μm or smaller. As a result, when the gross load applied to the photosensitive drum and the developing roller was 800 gf, the peak pressure was 60 gf/cm. In contrast, in a case of a developing roller having a hardness of 70 degrees, the peak pressure was over 150 gf/cm. This is because of the following reason. If the rubber hardness is high, the pressure cannot be reduced by the elastic layer and is directly transmitted to the metal core bar. Consequently, the metal core bar bends, resulting in a significant pressure difference in the longitudinal direction.

Therefore, regarding the runout accuracy, if, for example, a developing roller having a high hardness has different outside diameters at the central portion and the ends thereof in the longitudinal direction, changes in pressure due to variations in the outer shape cannot easily be reduced by the elastic layer. That is, if there are variations in shape, nonuniformity in pressure in the longitudinal direction often occurs.

Thus, to suppress the peak contact pressure produced between the photosensitive drum and the developing roller, the hardness of the developing roller is desired to be low. With a developing roller employing rubber having a low hardness, however, it is difficult to provide advantages both in performance and in cost. In the case of general-purpose rubber such as EPDM rubber, oil is in general added to the rubber so that the hardness is reduced. This, however, often leads to a problem due to deposition of oil. Moreover, if the hardness of the rubber is reduced, the internal structure is weakened. Therefore, the restoring force with respect to elastic deformation tends to be reduced. This leads to a problem that, if soft rubber having a hardness of about 50 degrees is used, it is unavoidable to use expensive silicon rubber so as to also provide good performance in terms of elasticity, conductivity, and so forth of the rubber. Accordingly, to suppress the peak pressure, the costs increase from the viewpoints of reduction in rubber hardness and effectiveness of highly accurate shape. Meanwhile, to suppress the bending, it is effective to increase the diameter of the metal core bar of the developing roller. In that case, however, it is apparent that the costs and the size of the development device increase.

As described above, changes in the pressing force produced between the photosensitive drum and the developing roller tend to cause the peak contact pressure not only to be simply shifted but also to be increased under the influence of the bend in the developing roller, resulting in the occurrences of regions subjected to high pressures.

In the present embodiment, changes in the pressing force produced between the photosensitive drum and the developing roller can be suppressed by employing the link mechanism. That is, changes in the pressing force due to the bend in the developing roller are suppressed, whereby the occurrences of regions subjected to high pressures and low pressures at the point of contact can be suppressed. This allows sufficient margins for the upper and lower limits of contact pressure at which image failure may occur, enabling the use of a developing roller having a high hardness. Moreover, relaxation of the runout accuracy of the developing roller and reduction in the size of the developing roller are effectively realized, whereby image quality can be improved.

Influence of Amount of Runout on Outside Diameter of Developing Roller

As described above, when the rubber hardness of the developing roller is increased, the nonuniformity in contact pressure increases relative to the nonuniformity in shape. Specific influences of the rubber hardness and the nonuniformity in shape upon the contact pressure were examined by conducting a simulation based on a finite-element method.

Developing rollers used in the simulation were provided with different rubber hardnesses and different shapes of outside diameter. The degrees of nonuniformity in pressure distribution when the developing rollers were individually brought into contact with the photosensitive drum were examined, and the allowances for nonuniformity in pressure distribution were compared, whereby specific relationships between the rubber hardnesses and the amounts of runout on the outside diameter were compared. In the simulation, the rubber hardness was varied between 50, 63, 72, and 81 degrees, the shape of the outside diameter was set to be a so-called crown shape, in which the central portion in the longitudinal direction had a larger outside diameter. The difference between the outside diameter in the central portion and the outside diameter at the ends was defined as the amount of runout on the outside diameter.

Figure 7:
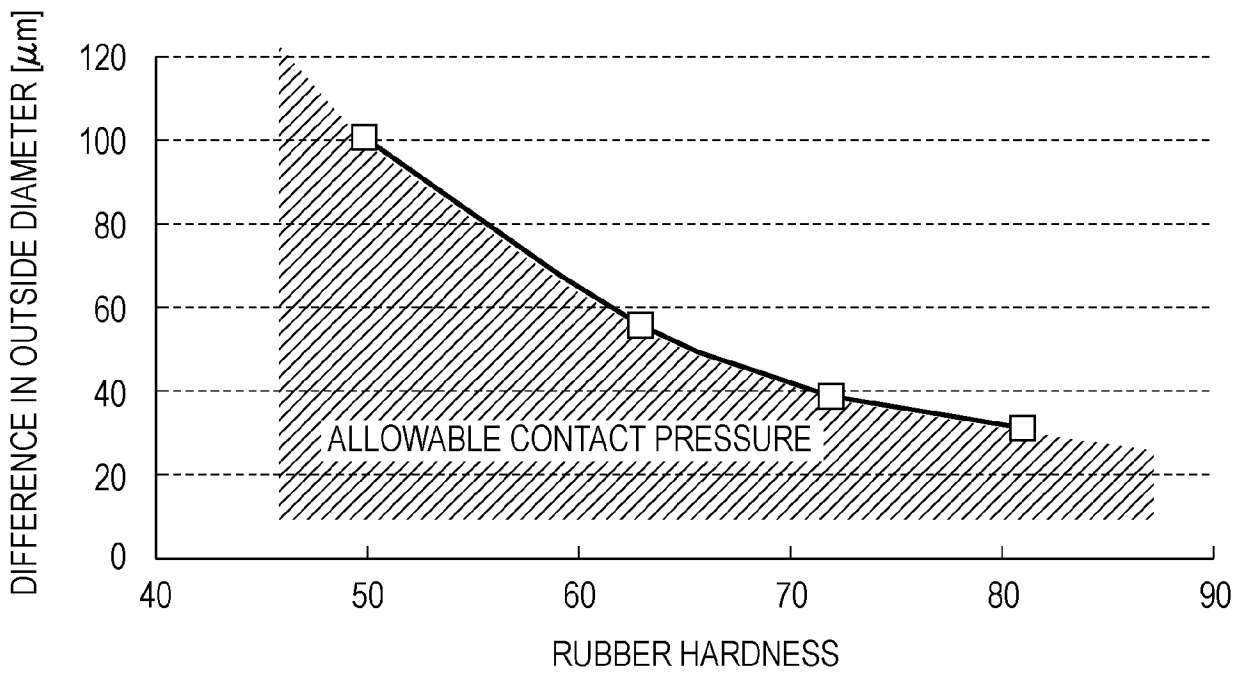
FIG. 7 is a graph showing the relationship between the rubber hardness and the allowable difference in outside diameter of a developing roller.

Conditions of the individual developing rollers when the peak pressure was within the range of 5 to 150 gf/cm, i.e., between the upper and lower limits of allowable contact pressure, were examined by changing the pressing force applied to the photosensitive drum. The results are shown in FIG. 7, indicating the following fact. For example, in the case of a developing roller having a hardness of 50 degrees, the peak pressure in the pressure distribution falls within the range of 5 to 150 gf/cm under a specific pressing force if the difference in outside diameter in the crown shape is 100 μm or smaller.

The results of the simulation shows that, for example, the range of allowable nonuniformity in peak pressure for the developing roller having a hardness of 50 degrees corresponds to a nonuniformity in shape of ±50 μm, whereas the range of allowable nonuniformity in peak pressure for the developing roller having a hardness of 70 degrees corresponds to a nonuniformity in shape of ±20 μm.

That is, the allowable level of nonuniformity in pressure distribution is substantially the same as that in the case where the elastic layer is made of silicon rubber or EPDM rubber. However, by employing the link mechanism according to the present embodiment, the accuracy in shape and the restriction on the hardness are relaxed, whereby a wide variety of material options can be provided.

Second Embodiment

Applications to Other than Contact Development System

The image forming apparatus including the link mechanism characterizing the present invention is also effective as an image forming apparatuses including a non-contact development system employing monocomponent developer and an image forming apparatus including a two-component development system, as well as an apparatus including the contact development system exemplified in the first embodiment.

Figure 8:
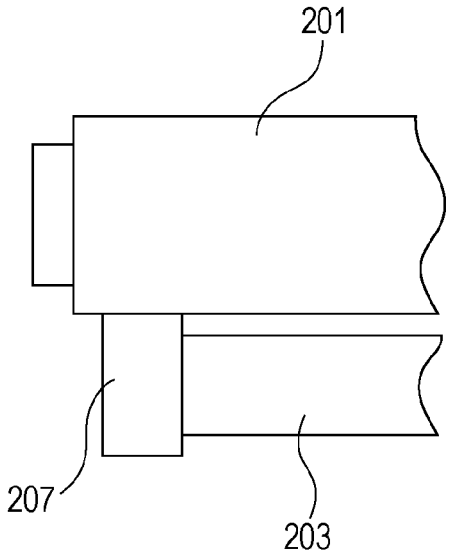
FIG. 8 is a schematic cross-sectional view showing an example of a development portion and relevant parts therearound included in a monocomponent non-contact development system.

FIG. 8 is a schematic cross-sectional view of a non-contact development system. In an image forming apparatus including a non-contact development system or a two-component development system, a developing sleeve 203, which is a metal sleeve, is provided in proximity to a photosensitive drum 201. Here, in a development area where the gap between the photosensitive drum 201 and the developing sleeve 203 is the smallest, the gap needs to be prevented from changing while the developing sleeve 203 is rotating. In this respect, cap-like stopper rollers 207 having a uniform thickness are provided at both ends of the developing sleeve 203. By pressing the developing sleeve 203 against the photosensitive drum 201 with the stopper rollers 207 interposed therebetween, the gap in the development area is maintained to be constant.

The stopper rollers 207 and the photosensitive drum 201, however, are both rigid bodies. Therefore, if there is any, even a slight, nonuniformity in shape on the surfaces of the stopper rollers 207 and the photosensitive drum 201, some regions may be subjected to very high pressures. In such regions, the developer may be fused onto the surfaces of the photosensitive drum 201 and the stopper rollers 207, reducing the stability of the gap in the development area. If the fusion of developer occurs at the points of contact with the stopper rollers 207, the gap becomes larger by the height of the fused developer, resulting in a horizontal line having lighter colors relative to those in surrounding parts of the image.

If the link mechanism described above is not employed, the loads applied to the stopper rollers 207 change with changes in the internal load of the development unit and the like, and image failure such as the one described above tends to occur more often under a larger pressing force.

In contrast, if the link mechanism is employed, the pressing forces applied to the stopper rollers 207 can be maintained stably at the smallest value required, and the occurrence of fusion of developer can be thus suppressed. Therefore, the link mechanism according to the present invention is also effective for an image forming apparatus including a monocomponent non-contact development system and an image forming apparatus including a two-component development system in terms of suppressing the occurrence of image failure and improving the image quality.

Third Embodiment

Applications to Other than Process Cartridge

In the first embodiment described above, the present invention is applied to a process cartridge including a mechanism configured to press a photosensitive drum and a developing roller against each other. The present invention may be applied to other mechanisms in an image forming apparatus each configured to press two rotatable members, specifically, an image bearing member and processing means acting on the image bearing member, against each other.

Figure 11:
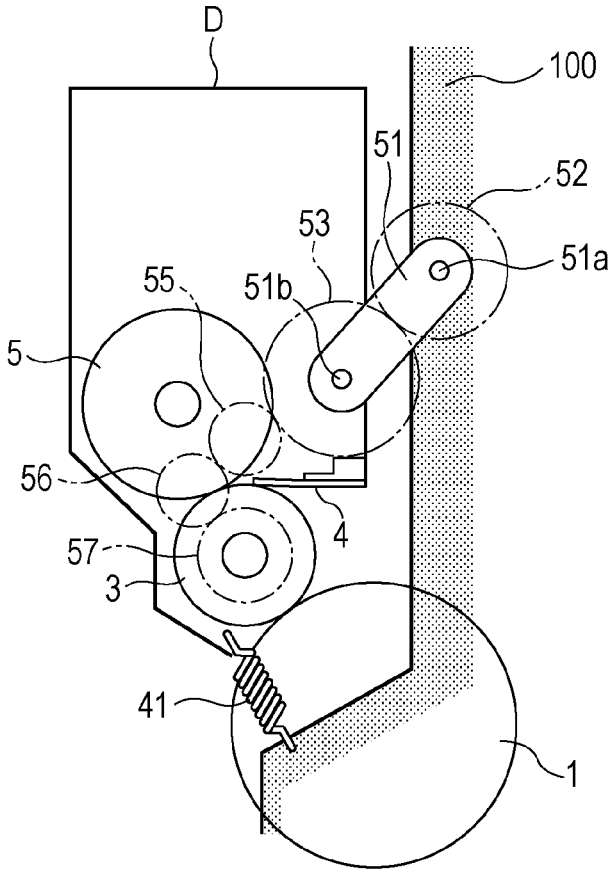
FIG. 11 is a schematic cross-sectional view showing a case where the development unit and an image-forming-apparatus body are connected to each other with the link member.

FIG. 11 shows a configuration in which the photosensitive drum 1, which is an image bearing member, is supported by an image-forming-apparatus body 100, which is a first frame member; and the development unit D, which is a second frame member, supporting the developing roller 3, which is processing means, is connected to the image-forming-apparatus body 100 with the link member 51 interposed therebetween. In this case, as in the first embodiment, the effect of suppressing changes in the contact pressure can be provided, and a stable contact state can be thus produced.

Figure 12:
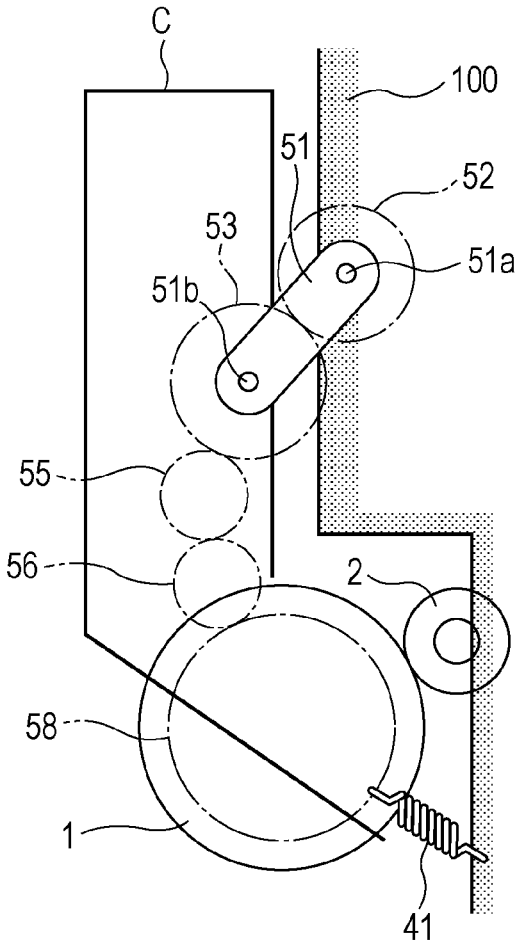
FIG. 12 is a schematic cross-sectional view showing a case where the drum unit and the image-forming-apparatus body are connected to each other with the link member.

In FIG. 12, the charging roller 2, which is processing means, is supported by the image-forming-apparatus body 100, which is a first frame member. Furthermore, the drum unit C, which is a second frame member, is connected to the image-forming-apparatus body 100 with the link member 51 interposed therebetween, the drum unit C including a mechanism in which the photosensitive drum 1, which is an image bearing member, is driven with a drum driving gear 58. In this case, as in the first embodiment, the effect of suppressing changes in the contact pressure can be provided, and a stable contact state can be thus produced.

Figure 13:
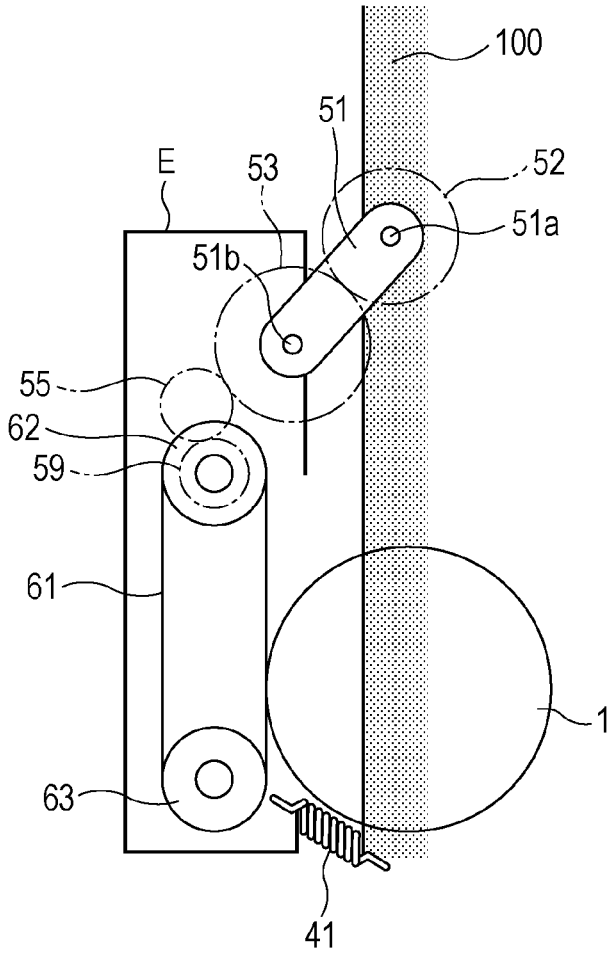
FIG. 13 is a schematic cross-sectional view showing a case where a transfer belt unit and the image-forming-apparatus body are connected to each other with the link member.

FIG. 13 shows a configuration in which a transfer belt unit E, which is a second frame member, is connected to the image-forming-apparatus body 100, which is a first frame member, with the link member 51 interposed therebetween. Here, a transfer belt 61, which is processing means, is stretched between a transfer driving roller 62 and a tension roller 63 with a constant tension and is driven by a transfer driving gear 59. In this state, the transfer belt 61 is pressed against the photosensitive drum 1, which is an image bearing member, supported by the image-forming-apparatus body 100. In this case, as in the first embodiment, the effect of suppressing changes in the contact pressure can be provided, and a stable contact state can be thus produced.

As described above, the present invention is applicable to a wide variety of image forming apparatuses in each of which a first frame member by which one of an image bearing member and processing means is rotatably supported and a second frame member by which the other of the image bearing member and the processing means is rotatably supported are connected to each other with a two-joint link mechanism.

According to the present invention, changes in the contact pressure produced between the photosensitive drum and the developing roller are suppressed, whereby image quality can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/071106, filed Dec. 18, 2009, which is hereby incorporated by reference herein in its entirety.

What is claimed is:

1. A process cartridge mountable into and demountable from an image-forming-apparatus body, the process cartridge comprising:

an image bearing member;

a first frame member by which the image bearing member is rotatably supported;

a developer bearing member that is pressed against the image bearing member and with which an electrostatic latent image formed on the image bearing member is developed;

a second frame member by which the developer bearing member is rotatably supported;

a link member rotatably connected to the first frame member and the second frame member at a first axis and a second axis located at a position different from a position at which the first axis is located on a plane perpendicular to an axis of the developer bearing member, respectively, and connecting the first frame member and the second frame member to each other in such a manner as to be movable with a two-joint link mechanism;

an urging member urging the first frame member and the second frame member such that the image bearing member and the developer bearing member are pressed against each other;

a first gear rotatably provided at the first axis and receiving a driving force from a drive source provided on the apparatus body; and a second gear rotatably provided at the second axis and transmitting the driving force from the first gear to the developer bearing member.

2. The process cartridge according to claim 1, wherein the developer bearing member is an elastic roller.

3. The process cartridge according to claim 1, wherein the urging member is a tension spring.

4. The process cartridge according to claim 1, wherein the link member is provided on each of one side and another side of the first frame member and the second frame member in a longitudinal direction of the image bearing member.

5. The process cartridge according to claim 1, wherein a force applied from the urging member to the second frame member includes a component acting in a direction opposite to a direction of a force applied from the link member to the second frame member and a component acting in a direction opposite to a direction of a force applied from the image bearing member to the second frame member.

6. The process cartridge according to claim 1, wherein a force applied from the urging member to the second frame member acts in a direction opposite to a direction of a resultant of a force applied from the link member to the second frame member and a force applied from the image bearing member to the second frame member.

7. The process cartridge according to claim 1, wherein the driving force from the first gear is transmitted to the second gear through an idler gear.

8. An image forming apparatus forming an image on a recording medium, the apparatus comprising:

an image bearing member;

processing means acting on the image bearing member;

a first frame member by which one of the image bearing member and the processing means is rotatably supported;

a second frame member by which the other of the image bearing member and the processing means is rotatably supported;

a link member rotatably connected to the first frame member and the second frame member at a first axis and a second axis located at a position different from a position at which the first axis is located on a plane perpendicular to an axis of the developer bearing member, respectively, and connecting the first frame member and the second frame member to each other in such a manner as to be movable with a two-joint link mechanism;

an urging member urging the first frame member and the second frame member such that the image bearing member and the processing means are pressed against each other;

a first gear rotatably provided at the first axis and receiving a driving force from a drive source; and a second gear rotatably provided at the second axis and transmitting the driving force from the first gear to the processing means.

9. The image forming apparatus according to claim 8, wherein the processing means is a developer bearing member for developing an electrostatic latent image formed on the image bearing member.

10. The image forming apparatus according to claim 9, wherein the developer bearing member is an elastic roller.

11. The image forming apparatus according to claim 8, wherein the urging member is a tension spring.

12. The image forming apparatus according to claim 8, wherein the link member is provided on each of one side and another side of the first frame member and the second frame member in a longitudinal direction of the image bearing member.

13. The image forming apparatus according to claim 8, wherein a force applied from the urging member to the second frame member includes a component acting in a direction opposite to a direction of a force applied from the link member to the second frame member and a component acting in a direction opposite to a direction of a force applied from the image bearing member to the second frame member.

14. The image forming apparatus according to claim 8, wherein a force applied from the urging member to the second frame member acts in a direction opposite to a direction of a resultant of a force applied from the link member to the second frame member and a force applied from the image bearing member to the second frame member.

15. The image forming apparatus according to claim 8, wherein the driving force from the first gear is transmitted to the second gear through an idler gear.

* * * * *

UNITED STATES PATENT AND TRADEMARK OFFICE

CERTIFICATE OF CORRECTION

PATENT NO. : 8,526,850 B2
APPLICATION NO. : 12/968497
DATED : September 3, 2013
INVENTOR(S) : Hiraku Sasaki et al.

It is certified that error appears in the above-identified patent and that said Letters Patent is hereby corrected as shown below:

On the title page, item (73), the Assignee of the subject patent should be:

CANON KABUSHIKI KAISHA
30-2, SHIMOMARUKO 3-CHOME, OHTA-KU
TOKYO, JAPAN 146-8501

Signed and Sealed this
Twenty-second Day of October, 2013

Teresa Stanek Rea

Teresa Stanek Rea
*Deputy Director of the United States Patent and Trademark Office*